US008269129B2

(12) United States Patent
Ren

(10) Patent No.: US 8,269,129 B2
(45) **Date of Patent: *Sep. 18, 2012**

(54) VACUUM SWITCH TUBE

(75) Inventor: Jianchang Ren, Beijing (CN)

(73) Assignee: Beijing Orient Vacuum Electric Co., Ltd., Beijing (CN)

( * ) Notice: Subject to any disclaimer, the term of this patent is extended or adjusted under 35 U.S.C. 154(b) by 410 days.

This patent is subject to a terminal disclaimer.

(21) Appl. No.: 12/698,873

(22) Filed: Feb. 2, 2010

(65) Prior Publication Data

US 2011/0186549 A1 Aug. 4, 2011

(51) Int. Cl.
*H01H 33/66* (2006.01)

(52) U.S. Cl. ..... 218/127; 218/123; 218/146

(58) Field of Classification Search ..... 218/10, 218/118, 121, 123–128, 146
See application file for complete search history.

(56) References Cited

U.S. PATENT DOCUMENTS 4,021,633 A * 5/1977 Kuwabara et al. ..... 200/262
4,636,600 A * 1/1987 Lipperts ..... 218/129
5,254,817 A * 10/1993 Inagaki ..... 218/132
6,853,525 B2 * 2/2005 Hetzmannseder et al. ..... 361/56
2004/0035827 A1 * 2/2004 Ren ..... 218/123
2004/0035828 A1 * 2/2004 Jianchang ..... 218/123
2011/0042354 A1 * 2/2011 Blalock et al. ..... 218/29

* cited by examiner

*Primary Examiner* — Amy Cohen Johnson
*Assistant Examiner* — Marina Fishman
(74) *Attorney, Agent, or Firm* — J.C. Patents

(57) ABSTRACT

The present invention relates to a vacuum switch tube, which includes a first conductive rod and a second conductive rod. A first contact is disposed at the first conductive rod. A second contact is disposed at the second conductive rod. The first contact and the second contact include conductive members and magnetic members, and are sealed in a vacuum tube body and correspondingly disposed. A front end of the first contact is disposed with a convex hemisphere. A front end of the second contact is disposed with a concave hemisphere matching with the front end of the first contact in shape. Therefore, the vacuum switch tube increases surface areas of the contacts, and reduces a resistance increase caused by the poor contacting effect. Meanwhile, a rotating magnetic field is formed between the convex hemisphere and concave hemisphere contacts, thereby facilitating arc-extinguishing and enhancing a breaking capability.

7 Claims, 3 Drawing Sheets

VACUUM SWITCH TUBE

FIELD OF THE TECHNOLOGY

The present invention relates to a vacuum switch tube, and more particularly to a vacuum switch tube with corresponding contacts disposed in an arc-extinguishing chamber, which belongs to the filed of electric technology.

BACKGROUND

A switch device plays an important role in a circuit, which functions to connect or disconnect the circuit. When the circuit is disconnected by the switch device, a switch tube generates an arc, and the arc dramatically raises the temperature of the members such as contacts in the switch tube, and even results in the loss of the members. Particularly, in a high voltage circuit, the intensity of the arc, which is generated when the circuit is disconnected, is rather high, and as a result, the service life of the switch tube is greatly shortened. Therefore, the arc-extinguishing must be performed for the switch tube in the ON/OFF process of the circuit.

In the prior art, an arc-extinguishing medium such as oil, sulfur hexafluoride ($SF_6$), air, semiconductor, or vacuum is usually used for arc-extinguishing in the switch device. Different arc-extinguishing media have different characteristics, and are suitable for the arc-extinguishing of circuit switches with different voltages. As the vacuum switch has small gaps, high voltage-resistant capability, low arc voltages, high current breaking capability, low electrical erosion, and long electrical endurance, the vacuum switch has been widely applied in high-voltage power circuits.

When the switch tube is disconnected, a contact area of contacts at two ends of the switch gradually decreases, until only one contact point is left between the contacts. At the same time, a contact resistance gradually increases, such that a temperature of an area where the contact point is located gradually rises. Once the temperature is higher than a melting point of the contact point, the contact point is melted, evaporated, and ionized. The metal vapor maintains the discharging in vacuum, so as to generate a vacuum arc. At the instant when the contacts are disconnected, flame-like cathode spots are formed on the contact surfaces, and thus eventually the contacts are electrically disconnected.

In the prior art, the contacts in the vacuum switch tube are usually column bodies. A magnetic member and a conductive member are disposed in each contact. When the switch is disconnected, the contact area of the contacts at two ends of the switch device gradually decreases, until only one contact point is left between the contacts. At the same time, the contact resistance gradually increases, such that the temperature of the area where the contact point is located gradually rises. Once the temperature is higher than the melting point of the contact point, the contact point is melted, evaporated, and ionized. The metal vapor maintains the discharging in vacuum, so as to generate a vacuum arc. At this time, the key point of the successful current breaking is that an insulation recovery speed at the gaps of the contacts is higher than a transient recovery voltage speed at the gaps of the contacts after the zero crossing of the arc current, such that re-ignition does not occur and the current breaking is successful. During the current breaking in the vacuum arc-extinguishing chamber, the metal vapor released by the arc diffuses rapidly during the zero crossing of the arc current and is condensed instantly upon encountering the contacts or surfaces of shielding case. However, in the current vacuum switch tube, due to the restriction of structural shapes of the contacts, it is usually very difficult to form a desirable vertical magnetic field for performing arc-extinguishing, and it is rather difficult to solve problems such as electric field concentration, insufficient voltage resistance and etc. during the high voltage breaking process. For a high voltage circuit, the 36-kilovolt voltage breaking can be realized in the prior art. For a higher voltage circuit, particularly, 72-kilovolt high voltage circuit, currently, no vacuum switch tube structure is available for satisfying effective arc-extinguishing requirements during the breaking process. This is one of the problems to be solved in the vacuum switch technology in the prior art.

SUMMARY

The subject of the present invention is to provide a vacuum switch tube, to reduce re-ignition possibility during voltage breaking, realize effective arc-extinguishing, and satisfy high voltage breaking requirements.

In order to realize the above subject, the present invention provides a vacuum switch tube, which includes a first conductive rod and a second conductive rod. A first contact is disposed at an end of the first conductive rod. A second contact is disposed at an end of the second conductive rod. The first contact and the second contact include conductive members and magnetic members. The first contact and the second contact are sealed in a vacuum tube body and correspondingly disposed. The conductive members and the magnetic members extend in the same direction and match adjacently with each other. A front end of the first contact is disposed with a convex hemisphere. A front end of the second contact is disposed with a concave hemisphere matching with the front end of the first contact in shape. A cross section of the magnetic member of the first contact is divided by a neutrality line into two unequal regions. The magnetic member of the first contact and the conductive member of the second contact are correspondingly disposed. The conductive member of the first contact and the magnetic member of the second contact are correspondingly disposed.

Preferably, a cross section of the first contact is equally divided into an upper left region, a lower left region, an upper right region, and a lower right region by its own vertical midline and horizontal midline. The upper right region is divided into a first upper right region neighboring the upper left region and a second upper right region other than the first upper right region. The lower left region is divided into a first lower left region neighboring the lower right region and a second lower left region other than the first lower left region. The conductive member is disposed in the first upper right region, the upper left region, and the second lower left region. The magnetic member is disposed in the first lower left region, the lower right region, and the second upper right region.

Preferably, the first upper right region and/or the first lower left region are half circles, a diameter edge of the first upper right region is adjacent to the upper left region. A diameter edge of the first lower left region is adjacent to the lower right region. The shape of the half circle region also may be replaced by circle-crown, trapezoid or triangular.

Preferably, each of the contact bodies of the first contact and the second contact is disposed in a cylindrical metal shell respectively.

The first contact and the second contact include a plurality of sheets laminated with each other respectively. Each of the sheets is formed by conductive sheets and magnetic sheets joining and combining with each other. A plurality of conductive sheets forms the conductive members. A plurality of magnetic sheets forms the magnetic members.

Securing holes penetrating each of the sheets are opened in the conductive sheets and the magnetic sheets. Securing columns are inserted in the securing holes. One end of each securing columns is secured at a bottom portion inside the metal shell.

Alternatively, the first contact and the second contact consist of a plurality of conductive and magnetic poles or particles adjacent each other closely.

The present invention provides a vacuum switch tube, which includes a first contact and a second contact correspondingly disposed. In one aspect, front ends of the first contact and the second contact are respectively configured into a convex hemisphere and a concave hemisphere matching with each other. In another aspect, the conductive member of the first contact and the magnetic member of the second contact are correspondingly disposed. The magnetic member of the first contact and the conductive member of the second contact are correspondingly disposed. Rotating lines of magnetic force having a rotating shape are formed between surfaces of the two contacts disposed correspondingly in use, so that the current breaking capability of the vacuum switch tube is increased, and an arc voltage is decreased. Furthermore, the problems about increased resistance and increased heating value caused by the poor contacting effect are solved, and the arc diffuses easily, so that the contacts can be used in a vacuum switch tube with a high voltage resistant capability, and the high voltage resistant capability of the vacuum switch tube is further enhanced, and thus the vacuum switch tube is especially suitable for a switch device in high-voltage electric power equipment.

The technical solutions of the present invention are further illustrated below in detail with reference to the accompanying drawings and embodiments.

DETAILED DESCRIPTION

The present invention provides a vacuum switch tube, which includes a first conductive rod and a second conductive rod. A first contact and a second contact are correspondingly disposed at ends of the conductive rods. The first contact and the second contact include conductive members and magnetic members extending in the same direction and joining with each other to form contact bodies respectively. The first contact and the second contact are sealed in a vacuum tube body and correspondingly disposed. A front end of the first contact is disposed with a convex hemisphere. A front end of the second contact is disposed with a concave hemisphere matching with the front end of the first contact in shape. The cross section of the magnetic member of the first contact is divided by a neutrality line into two unequal regions. The neutrality line is defined as follows: one region with arbitrary shape has a maximum characteristic length line. The region could be sandwiched between two parallel lines perpendicular to the characteristic length line, and the two parallel lines have a maximum distance and subject to a restriction that they could touch this region. A central line having the same distance depart from the two parallel lines is the neutrality line of this region. The technical solutions do not depart from the scope of the present invention, as long as the shape of the magnetic member of the first contact has the above shape characteristics. The magnetic member of the first contact and the conductive member of the second contact are correspondingly disposed. The conductive member of the first contact and the magnetic member of the second contact are correspondingly disposed.

The technical solutions of the present invention are further illustrated below with reference to specific embodiments.

First Embodiment of Vacuum Switch Tube

Figure 1:
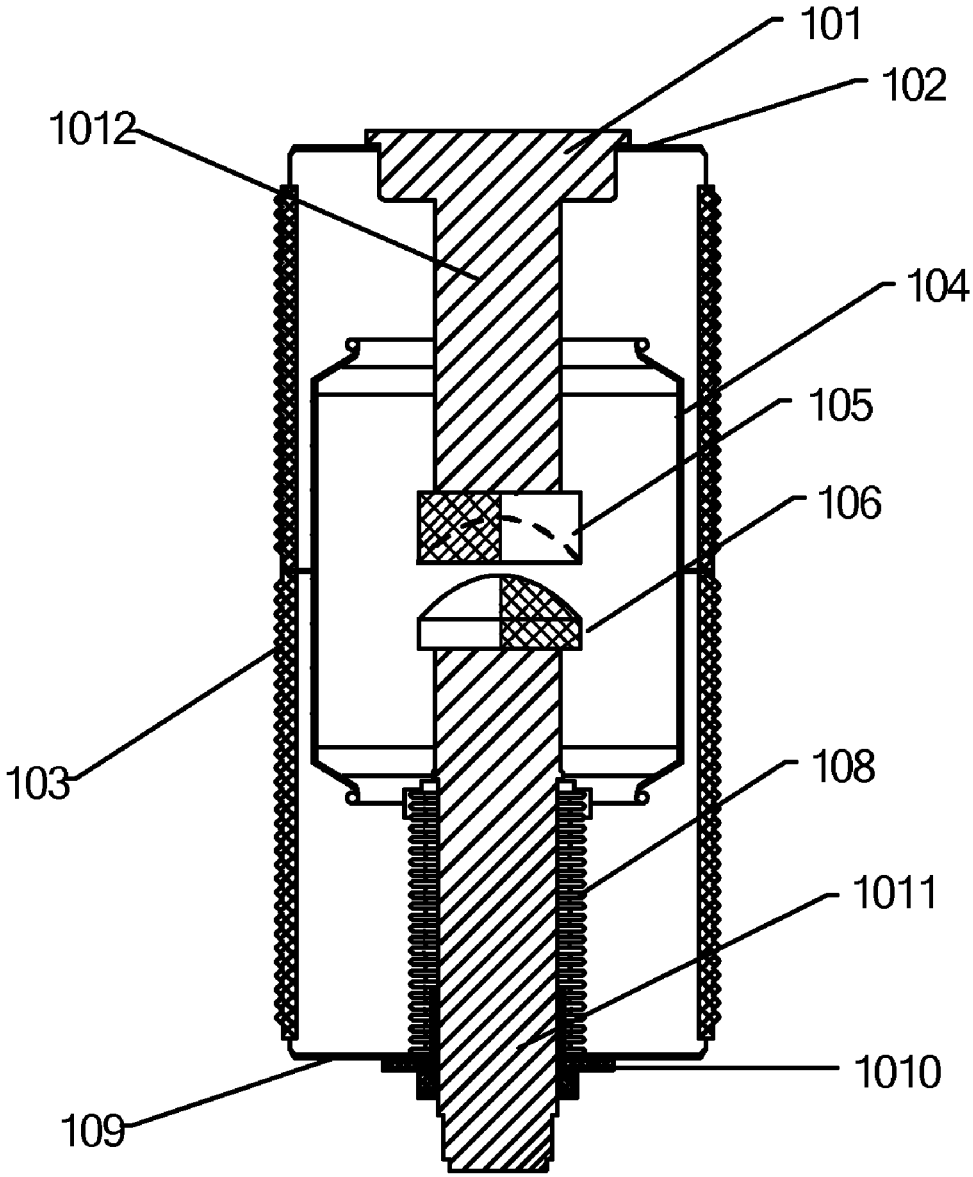
FIG. 1 is a schematic structural view of a vacuum switch tube according to a first embodiment of the present invention.

FIG. 1 is a schematic structural view of a vacuum switch tube according to a first embodiment of the present invention. As shown in FIG. 1, the vacuum switch tube includes an insulating housing 103, that is, a vacuum tube body. An upper end cover 102 and a lower end cover 109 are disposed at an upper end and a lower end of the insulating housing 103 respectively. Two conductive rods are disposed inside the insulating housing 103, which are a first conductive rod 1011 and a second conductive rod 1012 respectively. A first contact 106 is disposed at an end of the first conductive rod 1011. The first conductive rod 1011 slidably penetrates a through hole of the lower end cover 109 through a guide sleeve 1010. The guide sleeve 1010 is fixedly disposed in the through hole of the lower end cover 109. A through hole is opened in the guide sleeve 1010, so that the first conductive rod 1011 is enabled to slidably penetrate there through. A bellows 108 is further sleeved outside the first conductive rod 1011. The first conductive rod 1011 is connected to the guide sleeve 1010 through the bellows 108. A second contact 105 is disposed at an end of the second conductive rod 1012. The second conductive rod 1012 is secured on the upper end cover 102, and is fixedly connected to a switch frame of the vacuum switch with screws and keeps still. The second contact 105 and the first contact 106 are correspondingly disposed. An intermediate shielding case 104 is further disposed in the periphery of the second contact 105 and the first contact 106. A bellows shielding case is further disposed between the bellows 108 and the intermediate shielding case 104. As the bellow 108 can be stretched out and drawn back, the tightness of the vacuum switch tube during the movement of the first conductive rod 1011 can be ensured.

In the vacuum switch tube with the above structure, the connecting and disconnecting motions between the second contact and the first contact are realized with the movement of the first conductive rod. When the circuit needs to be turned on, the first conductive rod moves towards the second contact along an axis of the vacuum switch tube, and the second contact and the first contact are pressed together and contact each other, so that the circuit is turned on. When the circuit needs to be turned off, the first conductive rod moves in a direction away from the second contact along the axis of the vacuum switch tube, such that the second contact and the first contact are separated from each other rapidly, thereby cutting off the current of the circuit.

Figure 2:
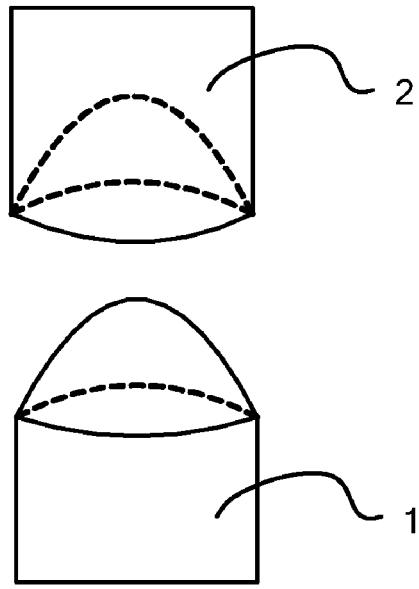
FIG. 2 is a schematic structural view of contacts in the vacuum switch tube according to the first embodiment of the present invention.

FIG. 2 is a schematic structural view of contacts in the vacuum switch tube according to the first embodiment of the present invention. The shapes of the first contact and the second contact in the vacuum switch tube are as shown in FIG. 2. The first contact 1 and the second contact 2 include conductive members and magnetic members respectively. The conductive members and the magnetic members extend in the same direction and match adjacently with each other. A front end of the first contact 1 is disposed with a convex hemisphere. A front end of the second contact 2 is disposed with a concave hemisphere matching with the convex hemisphere at the front end of the first contact 1. When is operated, the first contact moves along a direction A, to contact with the second contact.

In this embodiment, the front ends of the first contact and the second contact in the vacuum switch tube respectively adopt the convex hemisphere and the concave hemisphere matching with each other, so that a contact area between the first contact and the second contact is increased, the resistance increase caused by a poor contacting effect is reduced, the contacts are prevented from being overheated, melted, or evaporated, a density of an arc conducting medium is reduced, current breaking capability of the vacuum switch tube is enhanced, an arc voltage is reduced, so that the voltage breaking capability of the contacts is increased.

Figure 3:
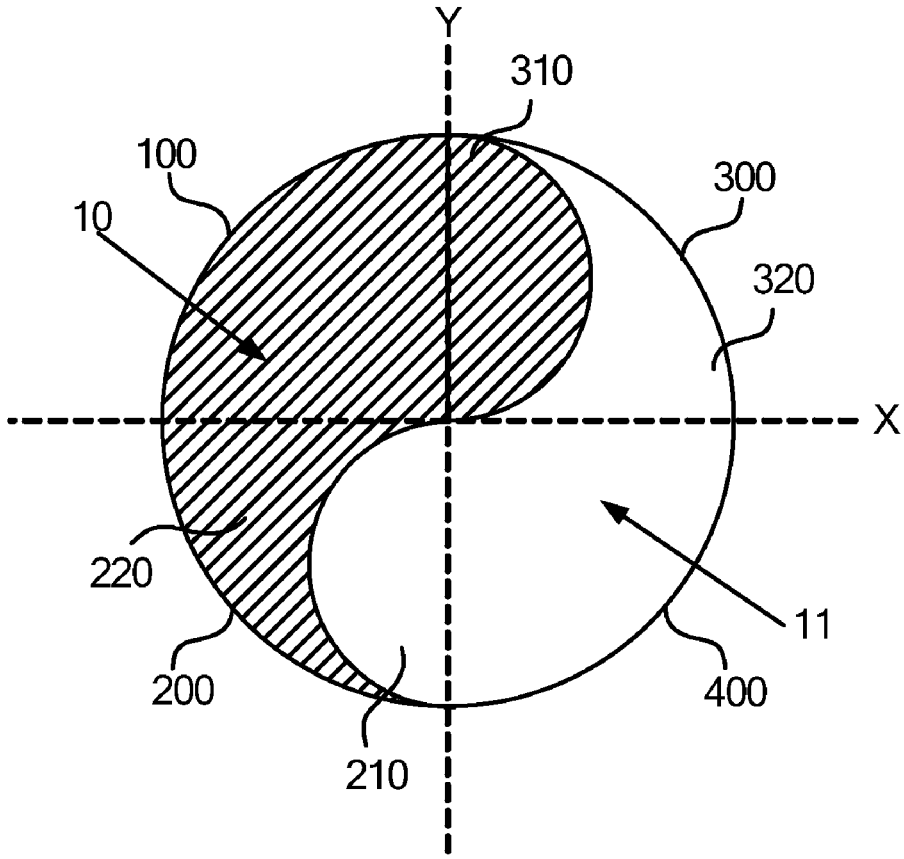
FIG. 3 is a schematic cross sectional structural view of a first contact in the vacuum switch tube according to the first embodiment of the present invention.

In the vacuum switch tube according to this embodiment, the first contact includes a conductive member and a magnetic member extending in the same direction and joining with each other to form a contact body, and the conductive member and the magnetic member are yin-yang-fish matched. That is, any cross section of the first contact, as shown in FIG. 3, is equally divided into an upper left region 100, a lower left region 200, an upper right region 300, and a lower right region 400 by its own horizontal midline X and vertical midline Y. The upper right region 300 is divided into a first upper right region 310 neighboring the upper left region 100 and a second upper right region 320 formed by an area other than the first upper right region 310. The lower left region 200 is divided into a first lower left region 210 neighboring the lower right region 400 and a second lower left region 220 formed by an area other than the first lower left region 210. The first upper right region 310 and the first lower left region 210 are half circles with diameters equal to a radius of the cross section. A diameter edge of the half circle in the first upper right region 310 is adjacent to the upper left region 100. A diameter edge of the half circle in the first lower left region 210 is adjacent to the lower right region 400. The conductive material, for example, copper, is disposed in the first upper right region 310, the upper left region 100, and the second lower left region 220 to form the conductive member 10. The magnetic material, for example, iron, is disposed in the first lower left region 210, the lower right region 400, and the second upper right region 320 to form the magnetic member 11. Therefore, the conductive member 10 and the magnetic member 11 are yin-yang-fish matched and joined with each other. As shown in FIG. 3, when the cross section of the magnetic member is sandwiched between two parallel lines which have the maximum distance, the transverse central line X of the first contact is the neutrality line of the cross section of the magnetic member.

The second contact also includes a conductive member and a magnetic member. A cross section of the front end of the second contact is annular, and a rear end may be a column body. Therefore, the conductive member and the magnetic member in the second contact may be symmetrically disposed. When the first contact and the second contact are applied in the vacuum switch tube, the first contact and the second contact are anti-symmetrically disposed. That is, the magnetic member of the first contact and the conductive member of the second contact are correspondingly disposed and the conductive member of the first contact and the magnetic member of the second contact are correspondingly disposed.

In the operating process of the vacuum switch tube in this embodiment, the magnetic member of the first contact generates lines of magnetic force when the conductive member is powered on. A distribution trend of the lines of magnetic force is flowing from a larger end to a smaller end of the yin-yang-fish shape of the magnetic member. When the contacts are applied, the first contact and the second contact are anti-symmetrically disposed. When a distance between the first contact and the second contact is smaller than half of a perimeter of a cross section perpendicular to an axial direction, the lines of magnetic force originally flowing from the larger end to the smaller end of the magnetic member of the first contact is changed to flow into the magnetic member of the second contact. The above phenomenon is realized based on the principle that the lines of magnetic force always select the shortest path to realize a loop between two poles.

In the above technical solution, the magnetic members and the conductive members are designed into a relation of joining and matching with each other, so that the lines of magnetic force are enabled to form a vertical magnetic field between the two contacts. When the switch is turned off and a distance between the two contacts gradually increases, the vertical magnetic field still can be maintained. Therefore, the vacuum switch tube with the above structure design can provide a vertical magnetic field for realizing effective arc-extinguishing, so that the arc-extinguishing capability is enhanced, the re-ignition possibility during voltage breaking is reduced, and an arc voltage is decreased, thereby satisfying high voltage breaking requirements. The technical solution in this embodiment can realize the capability of breaking a 72 kilovolts voltage. Meanwhile, a rotating magnetic field can be formed between the convex hemisphere and concave hemisphere contacts, which further facilitates arc-extinguishing, so as to enhance the voltage breaking capability of the vacuum switch tube. The technical solution of the present invention can realize the capability of breaking voltages of higher than 40.5 kilovolts such as 55 kilovolts, 72.5 kilovolts, 110 kilovolts and etc.

Particularly, the shape of the conductive member and the magnetic member of the first contact is not limited to be yin-yang-fish matched. When the cross section of the first contact is divided by using the above way, the shape of the half circle region also may be replaced by circle-crown, trapezoid, triangular, polygon, trapezoid-like or other shapes.

Second Embodiment of Vacuum Switch Tube

Figure 4:
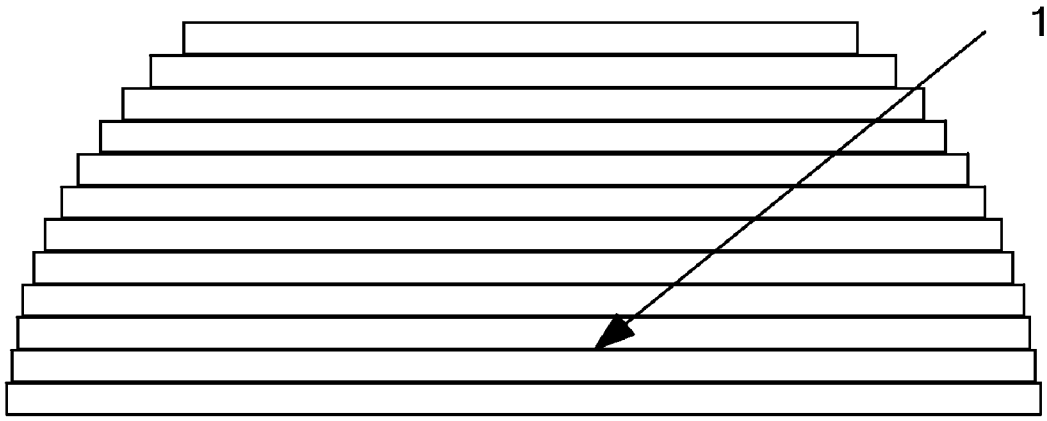
FIG. 4 is a schematic side structural view of a first contact in a vacuum switch tube according to a second embodiment of the present invention.

FIG. 4 is a schematic side structural view of a first contact in a vacuum switch tube according to a second embodiment of the present invention. In this embodiment, both contact bodies of a first contact and a second contact are formed by a plurality of sheets laminated in sequence. Each sheet is formed by conductive sheets and magnetic sheets joining and combining with each other. A plurality of conductive sheets forms the conductive members. A plurality of magnetic sheets forms the magnetic members. Shapes of cross sections of conductive sheets and magnetic sheets and a structural relation between the conductive members and the magnetic members may adopt the technical solution in the above embodiment, in which the conductive members and the magnetic members are yin-yang-fish matched or symmetrically disposed. An external profile shape of a contact is formed by laminating all sheets together, and a front end of the first contact 1 is as shown in FIG. 4. Besides the contact bodies of the first contact and the second contact, a metal shell is further disposed respectively, such that the contact is disposed in the metal shell to form a vacuum switch contact.

The above structure simplifies the manufacturing process of the vacuum switch tube. Each sheet is obtained through a simple molding process. Then, the sheet metals are melted over heating. When the temperature drops, the sheet metals are solidified to form the conductive member and the magnetic member respectively, and form an integral contact body.

Third Embodiment of Vacuum Switch Tube

Figure 5:
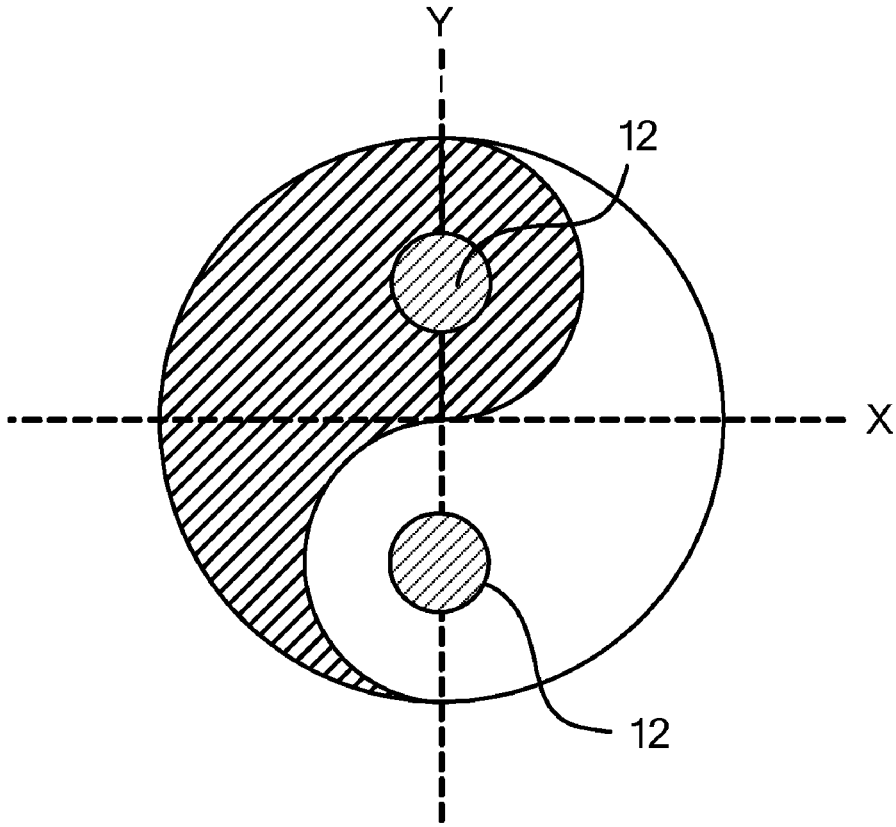
FIG. 5 is a schematic cross sectional structural view of a first contact in a vacuum switch tube according to a third embodiment of the present invention.

FIG. 5 is a schematic cross sectional structural view of a first contact in a vacuum switch tube according to a third embodiment of the present invention. On the basis of the second embodiment, in order to secure the relative positions of the conductive member and the magnetic member before the sheets are melted and solidified, securing holes 12 penetrating a plurality of sheets may be further opened in the conductive sheets and the magnetic sheets. Securing columns are inserted in the securing holes 12, as shown in FIG. 5, and one end of each securing columns is secured at a bottom portion inside the metal shell. The securing columns may be made of the same material as the conductive member, for example, copper.

The first contact and the second contact are not limited to consist of sheets, and the contact bodies also may be consist of a plurality of conductive and magnetic poles or particles adjacent each other closely.

The technical solution in this embodiment further simplifies the manufacturing process of the contact body. After a plurality of sheets is prepared by a simple molding process, the sheets may be put in a metal shell corresponding to a profile of the conductive member and the magnetic member. Then, a large current may be supplied to generate heat for heating the metal in the sheets, so that the metal in the sheets is melted and then solidified after the temperature drops, so as to form the conductive member and the magnetic member respectively.

To sum up, in the present invention, the front ends of the first contact and the second contact are designed as the convex hemisphere and the concave hemisphere matching with each other, so that surface areas of the first contact and the second contact are increased, the heat generated by the arc easily diffuses, the temperature of the first contact and the second contact is decreased, a density of the arc current is reduced, the high-temperature melting and evaporation of the surfaces of the first contact and the second contact is reduced, and the arc conducting medium is reduced, thereby facilitating the current breaking. Meanwhile, the conductive member and the magnetic member of the first contact are yin-yang-fish matched in shape, so as to form a rotating magnetic field, thereby facilitating the breaking of a high-voltage current.

Finally, it should be noted that the above embodiments are merely provided for describing the technical solutions of the present invention, but not intended to limit the present invention. It should be understood by persons of ordinary skill in the art that, although the present invention has been described in detail with reference to the preferred embodiments, modifications or equivalent replacements can still be made to the technical solutions of the present invention, as long as such modifications or equivalent replacements do not cause the modified technical solutions to depart from the spirit and scope of the present invention.

What is claimed is:

1. A vacuum switch tube, comprising: a first conductive rod and a second conductive rod, wherein a first contact is disposed at an end of the first conductive rod, a second contact is disposed at an end of the second conductive rod, the first contact and the second contact comprise conductive members and magnetic members, the first contact and the second contact are sealed in a vacuum tube body and correspondingly disposed, and the conductive members and the magnetic members extend in the same direction and match adjacently with each other; and characterized in that a front end of the first contact is disposed with a convex hemisphere, a front end of the second contact is disposed with a concave hemisphere matching with the front end of the first contact in shape, a cross section of the magnetic member of the first contact is divided by a neutrality line into two unequal regions, the magnetic member of the first contact and the conductive member of the second contact are correspondingly disposed, and the conductive member of the first contact and the magnetic member of the second contact are correspondingly disposed.

2. The vacuum switch tube according to claim 1, characterized in that a cross section of the first contact is equally divided into an upper left region, a lower left region, an upper right region, and a lower right region by a vertical midline and a horizontal midline thereof, the upper right region is divided into a first upper right region neighboring the upper left region and a second upper right region other than the first upper right region, the lower left region is divided into a first lower left region neighboring the lower right region and a second lower left region other than the first lower left region, the conductive member is disposed in the first upper right region, the upper left region, and the second lower left region, and the magnetic member is disposed in the first lower left region, the lower right region, and the second upper right region.

3. The vacuum switch tube according to claim 2, characterized in that the first upper right region and/or the first lower left region are half circles, a diameter edge of the first upper right region is adjacent to the upper left region, and a diameter edge of the first lower left region is adjacent to the lower right region.

4. The vacuum switch tube according to claim 1, characterized in that the first contact and the second contact are disposed in a cylindrical metal shell respectively.

5. The vacuum switch tube according to claim 4, characterized in that the first contact and the second contact comprise a plurality of sheets laminated with each other respectively, each of the sheets is formed by conductive sheets and magnetic sheets joining and combining with each other, and a plurality of conductive sheets forms the conductive members, a plurality of magnetic sheets forms the magnetic members.

6. The vacuum switch tube according to claim 5, characterized in that securing holes penetrating each of the sheets are opened in the conductive sheets and the magnetic sheets, securing columns are inserted in the securing holes.

7. The vacuum switch tube according to claim 4, characterized in that the first contact and the second contact consist of a plurality of conductive and magnetic poles or particles adjacent each other closely.

* * * * *